US007222992B2

(12) United States Patent
Holten et al.

(10) Patent No.: US 7,222,992 B2
(45) Date of Patent: May 29, 2007

(54) LUMINAIRE

(75) Inventors: Petrus Adrianus Josephus Holten, Winterswijk (NL); Paulus Gerardus Henricus Kosters, Winterswijk (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 260 days.

(21) Appl. No.: 10/510,307

(22) PCT Filed: Mar. 19, 2003

(86) PCT No.: PCT/IB03/01014

§ 371 (c)(1),
(2), (4) Date: Oct. 6, 2004

(87) PCT Pub. No.: WO03/087662

PCT Pub. Date: Oct. 23, 2003

(65) Prior Publication Data

US 2005/0225986 A1 Oct. 13, 2005

(30) Foreign Application Priority Data

Apr. 12, 2002 (EP) ..... 02076445

(51) Int. Cl.
*F21V 7/00* (2006.01)

(52) U.S. Cl. ..... 362/298; 362/147; 362/260; 362/346

(58) Field of Classification Search ..... 362/298, 362/299, 217, 223, 224, 260, 147, 404, 346, 362/243, 246

See application file for complete search history.

(56) References Cited

U.S. PATENT DOCUMENTS 2,556,690 A * 6/1951 Guth ..... 362/225
4,336,576 A * 6/1982 Crabtree ..... 362/240
4,794,501 A * 12/1988 Bartenbach ..... 362/298
5,195,818 A * 3/1993 Simmons et al. ..... 362/224

FOREIGN PATENT DOCUMENTS

DE 225382 9/1910

* cited by examiner

*Primary Examiner*—John Anthony Ward

(57) ABSTRACT

A luminaire includes at least two lamps and a main reflector whose outer edge defines a light emission window. A counter reflector is provided opposite the main reflector. Light originating from the lamps can only leave the luminaire through the light emission window after passing through a diffuser and/or a mixer which are positioned in a counter light emission window of the counter reflector and on an edge of the counter reflector, respectively. Homogeneously mixed light can thus be obtained from the luminaire when two lamps of different color temperatures are used.

20 Claims, 2 Drawing Sheets

LUMINAIRE

The invention relates to a luminaire comprising:

a reflector with a light emission window which is defined by a window edge of the luminaire;

contact means for accommodating at least a first and a second electric lamp;

a concave counter reflector positioned opposite the concave reflector at an opposite side of the contact means with respect to the concave reflector, said counter reflector facing the concave reflector with a counter light emission window situated in a plane T, which counter light emission window is defined by an edge of the counter reflector.

Such a luminaire is known from DE-225382. It is achieved in the known luminaire as a result of the position and shape of the counter reflector that light originating from the mounted first and second lamp can only issue from the light emission window via a reflection by the concave reflector. Light originating from the first and the second lamp is mixed inter alia owing to this reflection. If the first lamp has a different color temperature from the second lamp, this mixing is necessary for causing mixed light of a desired average color temperature and of a desired homogeneity to issue from the light emission window. The first lamp has a color temperature, for example, of 2700° C., and the second lamp has a second color temperature of, for example, 6500° C. The mixed light has a color temperature situated between these first and second color temperatures, for example 3300° C. A further mixing of the light is achieved in the known luminaire in that a diffusor is provided in the light emission window so as to close off the light emission window in its entirety. The known luminaire has the disadvantage that nevertheless an insufficient mixing of light originating from the first and the second lamp is obtained, with the result that light of an insufficient homogeneity issues from the light emission window. Other disadvantages of the known luminaire are that the lamps become comparatively hot owing to the fact that the light emission window is completely closed, and that the diffusor provided in the light emission window causes comparatively high light losses.

It is an object of the invention to provide a luminaire of the kind described in the opening paragraph in which the above disadvantages are counteracted. This object is achieved in that a luminaire of the kind described in the opening paragraph is characterized in that the luminaire is provided with a diffusor in the counter light emission window, while a chink is left free between the counter reflector and the diffusor, while the luminaire is further provided with mixing means which are positioned opposite the chink when viewed in a direction perpendicular to plane T. The diffusor thus positioned achieves that light directly coming from the lamp and light obtained from reflection against the counter reflector are mixed by the diffusor before being incident as mixed light on the reflecting surface of the concave reflector and subsequently leaving the luminaire. A simple construction of the luminaire of the invention is obtained when the mixing means extend along the edge and from the edge over the chink. In contrast to the known luminaire, where mixing of light does not take place until the light leaves the luminaire, the light is mixed already in the luminaire according to the invention, i.e. while the light is passing through the diffusor provided in the counter light emission window. At least a portion of the light coming from the counter reflector will not be incident on the diffusor but will pass through the chink and hit the mixing means. These mixing means realize a subsequent mixing of unmixed light that has passed alongside the diffusor, for example in that this unmixed light is diffusely scattered by a further diffusor forming part of the mixing means. Alternatively, the mixing means may throw the unmixed light back onto the counter reflector, whereupon the counter reflector reflects this returned unmixed light towards the diffusor, so that this light is mixed by the diffusor after all. A further homogeneity of the mixed light is thus achieved, which is of particular importance when lamps of different color temperatures are used. It is found that said improved homogeneous mixed light is obtained at the cost of comparatively low light losses. The chink present between the diffusor and the edge of the counter reflector also counteracts that the lamps become comparatively hot. The chink has a minimum chink width S, such that a desired cooling of the lamps by a flow of air through the chink is promoted. The chink may have a constant width, or it may alternatively have a chink width which shows a gradient, or, for example, a chink may extend along only two sides of the diffusor, while the diffusor has two ends by which the diffusor is connected to the edge. The reflector may be of concave or convex shape. A reflector of such a shape renders it possible in a comparatively simple manner to realize a desired focusing, spreading, and/or directing of the mixed light. It is alternatively possible for the reflector to be planar and, for example, to be provided with Fresnel facets; the light emission window in a reflector of such a shape coincides with the reflecting surface of the planar reflector. A planar reflector has the advantage that the luminaire may have a comparatively small dimension in a direction perpendicular to the light emission window.

An efficient and comparatively simple manner for throwing back the unmixed light onto the counter reflector is achieved in an embodiment of the luminaire in which the mixing means comprise a light-transmitting prism. The characteristic angular shape of the prism and a reasonably accurately determined angle of incidence onto the prism of the light beams going past the diffusor, which angle of incidence is defined inter alia by the chink width, achieves that substantially all light beams are thrown back onto the counter reflector given a favorable position of the prism. Preferably, the position and the shape of the prism are chosen such that the prism has a base enclosing an angle $\alpha$ with the plane T of the counter light emission window, which angle $\alpha$ has a value in a range from 0 to 15°. It was also found to be favorable in a further preferred embodiment of the luminaire that the prism has an apex angle $\beta$, which apex angle $\beta$ has a value in a range from 80 to 100°.

In an alternative embodiment of the luminaire according to the invention, the mixing means comprise a plurality of interconnected, partly overlapping prisms, each prism having a respective base which has substantially the same orientation as the bases of the other prisms. It is achieved thereby that a comparatively great chink width can be optically covered by the mixing means without this leading to a comparatively bulky and heavy embodiment of the mixing means. It is also achieved that comparatively little material is required for the mixing means, and that the luminaire can be manufactured with a comparatively lightweight construction.

In a preferred embodiment, the diffusor in the luminaire is provided with transverse slots which extend in a transverse direction perpendicularly to a longitudinal direction of the diffusor. The transverse slots may extend over almost the entire transverse direction of the diffusor without interrupting the outer edges of the diffusor, so that the diffusor consists of one piece. The transverse slots may have a width of, for example, 1 mm or, for example, 3 mm. If the transverse slots extend over the entire transverse direction, the diffusor will be subdivided into a plurality of diffusor parts, each diffusor part then having a partial length, for example of 90 mm. The diffusor parts together form the diffusor, for example a diffusor with a total length of 1200 mm. It is achieved by means of the transverse slots that the diffusor can extend over the entire counter light emission window, from one edge to the opposite edge, while the desired cooling of the lamps is maintained. The presence of the transverse slots also achieves that a possible warping of the diffusor caused by heating and expansion of the diffusor during lamp operation is counteracted. A favorable, further cooling of the lamps is also achieved as a result of the air flow through the transverse slots. No adverse effect on the quality of the mixed light was observed in luminaires provided with diffusers having such transverse slots. If the luminaire is in addition provided with transverse lamellae between the diffusor and the reflector, a transverse slot is preferably positioned opposite a respective transverse lamella, as viewed in a direction perpendicular to the light emission window. Alternatively, the mixing means, for example light-transmitting prisms, may be provided opposite the transverse slots, alone or in addition to mixing means already present, in an alternative embodiment of the luminaire according to the invention. The (additional) positioning of a respective mixing means opposite each transverse slot counteracts a possible negative effect of the transverse slots on the quality of the mixed light.

In a favorable embodiment of the luminaire, the diffusor is of convex shape where facing the concave reflector, while the diffusor has an outer edge which is situated between a plane C through the contact means and the plane T. The concave reflector is screened off from a direct irradiation by the lamps owing to this measure. Therefore, light cannot fall directly, i.e. without reflection, onto the concave reflector, but only via the diffusor or via the mixing means. It was found that light losses are limited by a diffusor shaped and positioned in this manner.

The dimensions and shape of the relevant diffusor may be adapted to the lamp in question. Thus it is possible, for example, to obtain a higher luminous flux from the luninaire or to choose the dimensions of the luminaire to be as favorable as possible, for example as small as possible. It was found that comparatively good results are obtained with a luminaire according to the invention wherein the diffusor has a V-shaped cross-section, an apex of the V being directed towards the concave reflector. Preferably, the apex has an apex angle $\gamma$, which angle $\gamma$ has a value in a range from 120 to 160°.

An example of a luminaire according to the invention with a respective diffusor is a luminaire for low-pressure mercury vapor gas discharge lamps in which the lamps as well as the diffusor and the mixing means are elongate in shape. It is especially low-pressure mercury vapor gas discharge lamps which are suitable for being manufactured with different color temperatures, for example color temperatures of 2700° C. and 6500° C., respectively. When lamps of such different color temperatures are used in the luminaire according to the invention, a homogeneous mixed light of a color temperature lying in a range between 2700 and 6500° C., for example 5000° C., can be obtained from the luminaire in dependence on a ratio of intensities with which the lamps are operated.

An embodiment of the luminaire according to the invention is diagrammatically shown in the drawing, in which.

Figure 1:
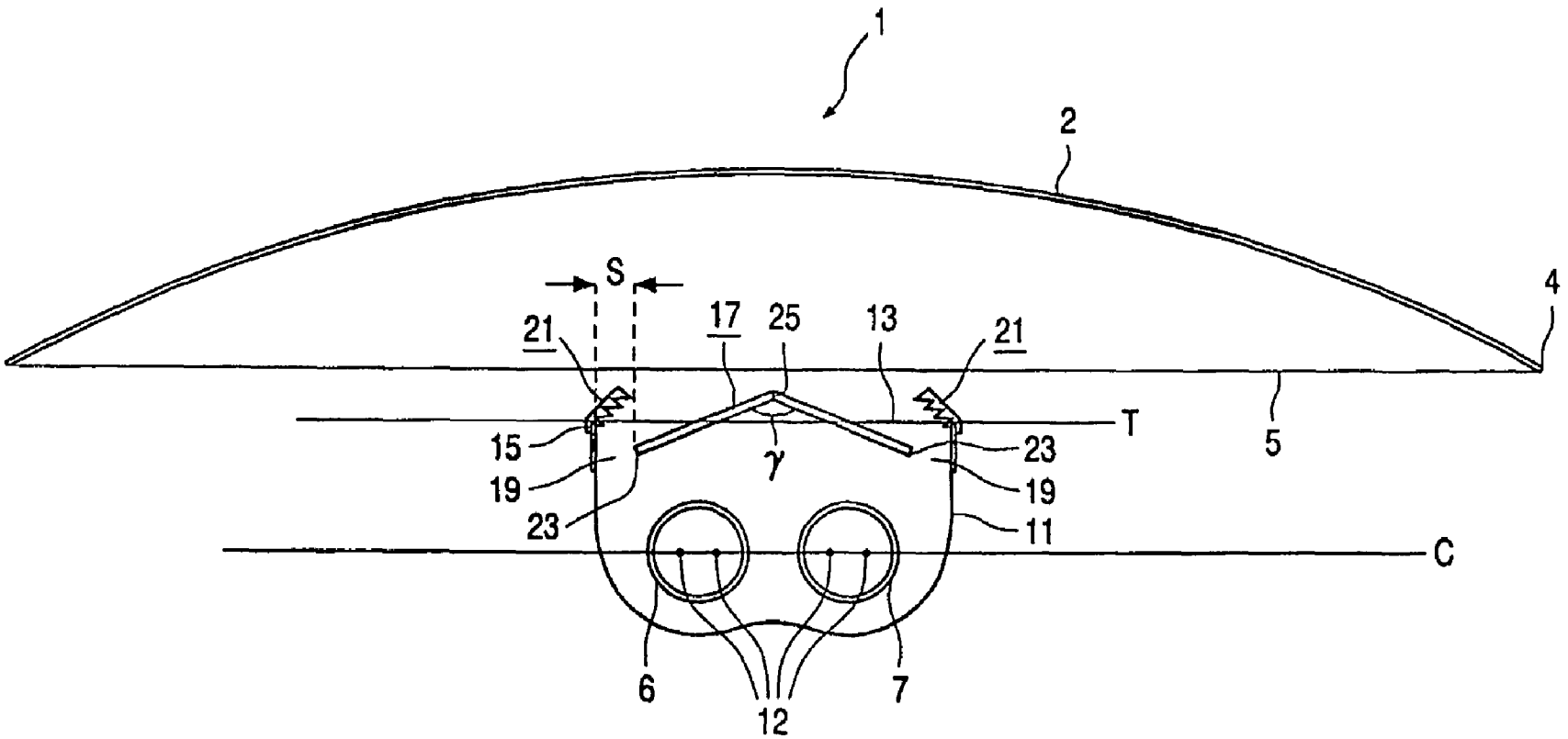
FIG. 1 is a cross-sectional view of a first embodiment of a luminaire according to the invention.

FIG. 1 shows a luminaire 1 comprising a concave reflector 2 whose window edge 4 defines a light emission window 5. The luminaire is provided with contact means 12 situated in a plane C, in which means a first 6 and a second electric lamp 7, low-pressure mercury vapor discharge lamps with color temperatures of 2700° C. and 6500° C., respectively, in the Figure, are accommodated. The luminaire is further provided with a counter reflector 11 with a counter light emission window 13 situated in a plane T. The counter reflector is positioned substantially at an opposite side of the contact means 12 with respect to the concave reflector, opposite the concave reflector 2 and facing the latter with its counter light emission window. The counter light emission window is bounded by an edge 15 of the counter reflector. The luminaire is provided with a diffusor 17 in the counter light emission window, which diffusor leaves a chink 19 with a chink width S free between the edge and the diffusor. The diffusor has a length which extends in a direction perpendicular to the plane of drawing and is provided with a plurality of transverse slots (not shown in the Figure), each having a length of 30 mm and a width of 1.5 mm, with mutual interspacings of 30 mm. The diffusor is convex in shape where it faces the concave reflector and has a V-shaped cross-section, and the diffusor has an outer edge 23 which is situated between the plane C and the plane T. The diffusor has an apex 25 with an apex angle $\gamma$ which angle $\gamma$ has a value in a range between 120 and 160°, a value of 135° in the Figure. The luminaire is further provided with mixing means 21 which extend along the edge 15 and from the edge over the chink 19.

Figure 2A:
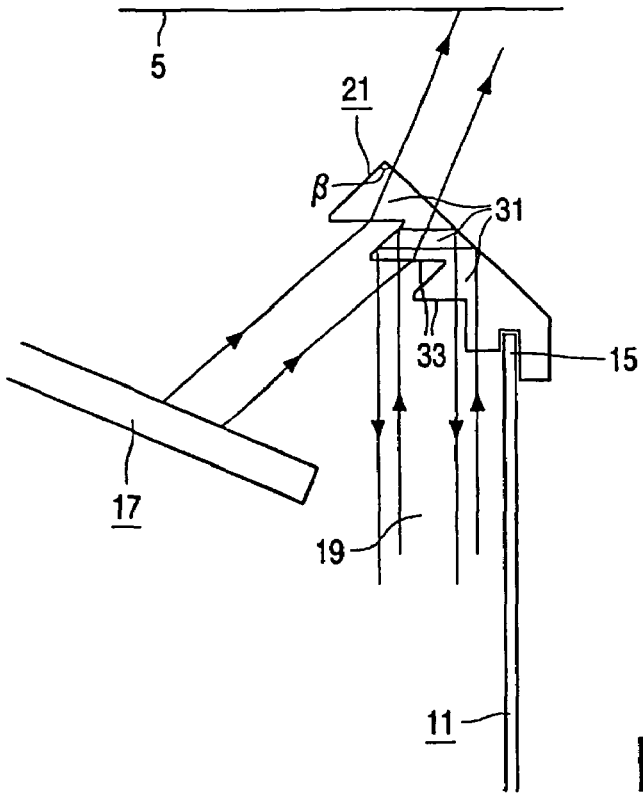
FIG. 2A is a cross-sectional view of a detail of the luminaire of FIG. 1.

FIG. 2A shows a detail of the mixing means 21 which are clamped around the edge 15 of the counter reflector 11. The mixing means may be manufactured, for example, from glass or a transparent synthetic resin, for example PMMA (perspex or polymethylmethacrylate), or PC (polycarbonate). The mixing means comprise a plurality of interconnected light-transmitting prisms 31, each with a respective base 33, such that the base of each prism substantially has the same orientation as the bases of all other prisms. Each prism has an apex angle $\beta$, which apex angle $\beta$ has a value in a range from 80 to 100°, 90° in the Figure. The Figure also shows that light coming from the diffusor 17 and incident on the mixing means passes through the light emission window 5 after passing through the mixing means. By contrast, light incident on the mixing means through the chink 19 is reflected by these mixing means to the counter reflector 11.

Figure 2B:
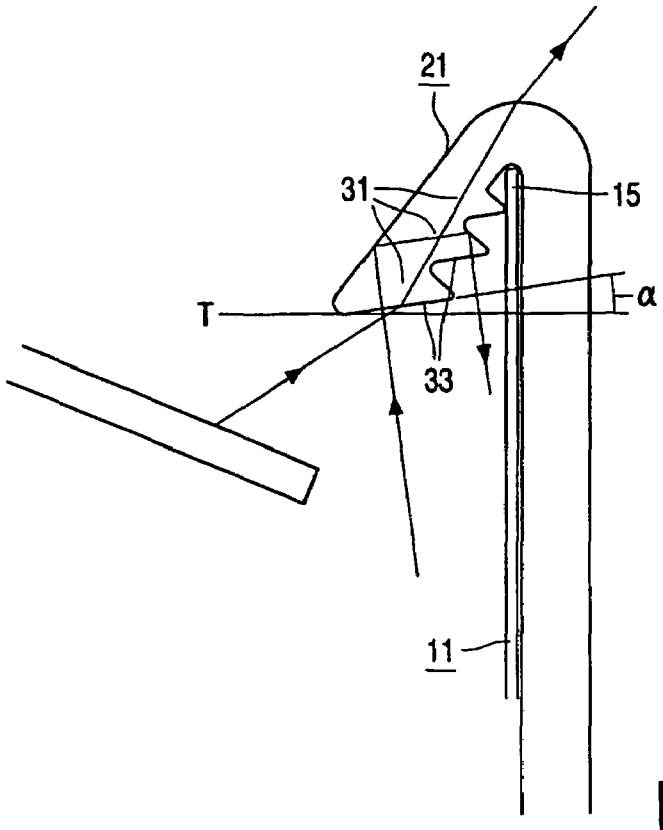
FIG. 2B is a cross-sectional view of a detail of a second embodiment of a luminaire according to the invention.

FIG. 2B shows a detail of a second embodiment of the luminaire according to the invention. The plurality of prisms 31 of the mixing means 21 is provided on the edge 15 of the counter reflector 11 in a somewhat pivoted position. The bases 33 of the prisms enclose an angle $\alpha$ with the plane T of the counter light emission window, which angle $\alpha$ has a value in a range from 0 to 15°, 7° in the Figure.

The invention claimed is:

1. A luminaire comprising:

a main reflector with a light emission window which is defined by a window edge of the luminaire;

contact means for accommodating at least a first and a second electric lamp;

a counter reflector positioned opposite the main reflector at an opposite side of the contact means, said counter reflector facing the main reflector with a counter light emission window situated in a plane T, wherein said counter light emission window is defined by an edge of the counter reflector;

a diffuser in the counter light emission window, wherein a chink is left free between the counter reflector and the diffuser; and mixing means which are positioned opposite the chink when viewed in a direction perpendicular to plane T.

2. The luminaire as claimed in claim 1, wherein the mixing means extend along the edge and from the edge over the chink.

3. The luminaire as claimed in claim 1, wherein the mixing means comprise a light-transmitting prism.

4. The luminaire as claimed in claim 3, wherein the prism has a base enclosing an angle with the plane T of the counter light emission window, which angle has a value in a range from 0 to 15°.

5. The luminaire as claimed in claim 3, wherein the prism has an apex angle β, which apex angle β has a value in a range from 80 to 100°.

6. The luminaire as claimed in claim 4, wherein the mixing means comprise a plurality of interconnected, partly overlapping prisms, each prism having a respective base which has substantially the same orientation as the bases of the other prisms.

7. The luminaire as claimed in claim 1, wherein the diffuser is provided with transverse slots which extend in a direction transverse to a longitudinal direction of the diffuser.

8. The luminaire as claimed in claim 7, wherein the mixing means are located opposite the transverse slots, between the diffuser and the main reflector.

9. The luminaire as claimed in claim 1, wherein the diffuser is of convex shape where it faces the main reflector, and the diffuser has an outer edge which is situated between a plane C through the contact means and the plane T.

10. The luminaire as claimed in claim 7, wherein the diffuser has a V-shaped cross-section.

11. The luminaire as claimed in claim 10, wherein the diffuser has an apex with an apex angle y, which angle y has a value in a range from 120° to 160°.

12. A luminaire comprising:

a main reflector having a main edge defining a light emission window;

a counter reflector positioned opposite the main reflector and partially surrounding a first lamp and a second lamp, the counter reflector having a counter edge defining a counter emission window;

a diffuser located in the counter emission window and separated from the counter reflector by a gap; and at least one prism positioned near the gap.

13. The luminaire of claim 12, wherein the diffuser is configured to mix light rays from the first lamp and the second lamp.

14. The luminaire of claim 12, wherein the at least one prism is configured to at least one of mix light rays from the first lamp and the second lamp passing through the gap and reflect the light rays back towards the counter reflector for reflection towards the diffuser.

15. The luminaire of claim 12, wherein the at least one prism extends along the counter edge and over the gap.

16. The luminaire of claim 12, wherein the at least one prism further comprises a plurality of interconnected, partly overlapping prisms, bases of the prisms having substantially a same orientation.

17. The luminaire of claim 12, wherein the diffuser is convex and faces the main reflector which is concave, and wherein the diffuser has an outer edge which is situated between a plane of the counter emission window and a plane through contacts that hold the first lamp and the second lamp.

18. The luminaire of claim 12, wherein the diffuser has a V-shaped cross-section with an apex angle γ which is from 120° to 160°.

19. The luminaire of claim 12, wherein the diffuser and the at least one prism are located such that light from the first lamp and the second lamp can only reach the main reflector through the diffuser or the at least one prism.

20. The luminaire of claim 12, wherein the counter edge extends beyond the first lamp and the second lamp.

* * * * *